US007123081B2

(12) United States Patent
Lyon

(10) Patent No.: US 7,123,081 B2
(45) Date of Patent: Oct. 17, 2006

(54) TEMPERATURE COMPENSATED FET CONSTANT CURRENT SOURCE

(75) Inventor: Jason Perry Lyon, Longmont, CO (US)

(73) Assignee: Agere Systems Inc., Allentown, PA (US)

( * ) Notice: Subject to any disclaimer, the term of this patent is extended or adjusted under 35 U.S.C. 154(b) by 80 days.

(21) Appl. No.: 10/988,071

(22) Filed: Nov. 13, 2004

(65) Prior Publication Data

US 2006/0103454 A1 May 18, 2006

(51) Int. Cl.
*G05F 1/10* (2006.01)

(52) U.S. Cl. ..... 327/543; 327/103; 327/513

(58) Field of Classification Search ..... 323/312, 323/313, 314; 327/103, 512, 513, 530, 534, 327/535, 537, 538, 539, 540, 543
See application file for complete search history.

(56) References Cited

U.S. PATENT DOCUMENTS 4,943,737 A * 7/1990 Guo et al. ..... 327/542
5,391,979 A * 2/1995 Kajimoto et al. ..... 323/313
5,883,798 A * 3/1999 Yamaguchi ..... 363/73
6,459,326 B1 * 10/2002 Descombes ..... 327/513
6,466,081 B1 * 10/2002 Eker ..... 327/541
6,982,590 B1 * 1/2006 Seshita ..... 327/539

OTHER PUBLICATIONS

D. A. Badillo, "CMOS Current Reference . . . ," *IEEE Symp. on Circuits and Systems-III,* vol. 3, pp. 197-200 (May 2002).

R. Dehghani et al., "A New Low Voltage Precision CMOS Current Reference . . . ," *IEEE Symp. on Circuits and Systems-II,* vol. 50, No. 12, pp. 928-932 (Dec. 2003).

* cited by examiner

*Primary Examiner*—Jeffrey Zweizig

(57) ABSTRACT

A constant current source comprises a FET, a bandgap reference voltage source coupled to its gate terminal and a resistor coupled to its source terminal. The width and length of the FET are configured so that the temperature coefficient (TEMPCO) of $V_{gs}$ of the transistor offsets the TEMPCO of the resistor.

9 Claims, 3 Drawing Sheets

TEMPERATURE COMPENSATED FET CONSTANT CURRENT SOURCE

BACKGROUND OF THE INVENTION

1. Field of the Invention

This invention relates to FET constant current sources and, more particularly, to temperature compensation in such circuits.

2. Discussion of the Related Art

Integrated circuits (ICs) often require a constant current source; that is, a current reference that is both accurate and stable with respect to temperature and variations in manufacturing process. In the prior art, the ICs that implement such a constant current source are typically both complex and inefficient; that is, wasteful in terms of chip area utilized and power consumed. Constant current sources that are illustrative of prior art approaches include D. A. Badillo, *IEEE Symp. on Circuits and Systems-III*, Vol. 3, pp. 197–200 (May 2002) and R. Dehghani et al., *IEEE Symp. on Circuits and Systems-II*, Vol. 50, No. 12, pp. 928–932 (December 2003), both of which are incorporated herein by reference. The Badillo paper describes a CMOS current reference circuit that places a level shift stage between a feedback amplifier and a bandgap reference (BGR) voltage source in order to increase the temperature operating range. The Dehghani et al. paper also describes a CMOS current reference circuit based on a BGR voltage source and a CMOS circuit similar to a beta amplifier but modified by the inclusion of an NMOS transistor that functions as a resistor. The NMOS transistor is operated in the triode region to achieve a current that has a negative temperature coefficient and only oxide thickness dependence. The BGR voltage has a positive temperature coefficient that cancels the negative temperature coefficient of the beta amplifier.

Thus, a need remains in the art for an accurate, stable constant current source, which can be implemented in MOS technology without the complexity and inefficiency typified by prior art designs.

BRIEF SUMMARY OF THE INVENTION

In accordance with one aspect of my invention, a constant current source comprises a field effect transistor (FET), a constant voltage source coupled to its gate terminal, and a resistor coupled to its source terminal. The width and length of the FET are configured so that the temperature coefficient (TEMPCO) of $V_{gs}$ of the transistor offsets the TEMPCO of the resistor.

BRIEF DESCRIPTION OF THE SEVERAL VIEWS OF THE DRAWING

My invention, together with its various features and advantages, can be readily understood from the following more detailed description taken in conjunction with the accompanying drawing, in which.

DETAILED DESCRIPTION OF THE INVENTION

Figure 1:
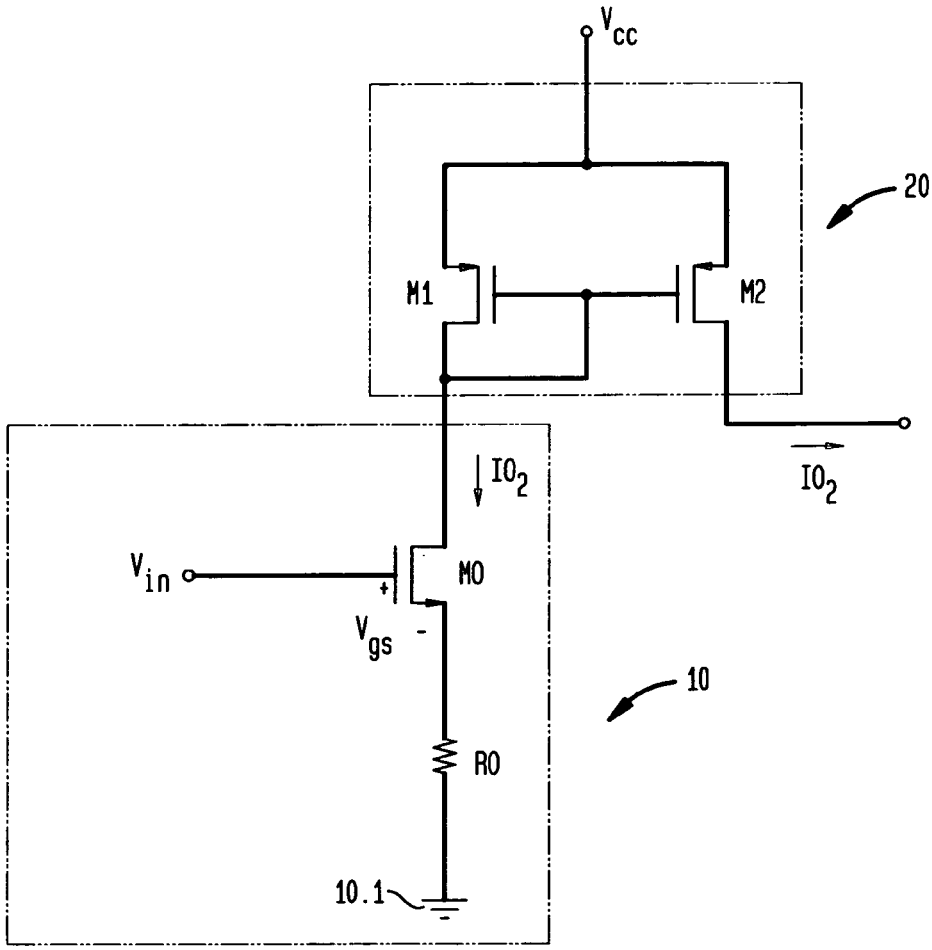
FIG. 1 is a circuit diagram of a constant current source in accordance with one embodiment of my invention.

With reference now to FIG. 1, an IC constant current source 10, in accordance with one embodiment of my invention, comprises an NMOS FET M0 having its drain terminal coupled to a source of reference potential (e.g., ground 10.1) through an on-chip resistor R0. Resistor R0 is depicted as a single element, but in practice it may be a resistive network including a combination of resistors connected in series or parallel with one another. Likewise, M0 is depicted as an NMOS FET, but in practice could alternatively be a PMOS FET. The drain terminal of M0 is coupled to a source of supply voltage (e.g., $V_{cc}$) and delivers an output current $I0_1$. The gate terminal of M0 is coupled to a source of input voltage (e.g., $V_{in}$), which is essentially constant with changes in temperature over the operating range of the current source; that is the TEMPCO of $V_{in}$ is essentially equal to zero. Preferably, $V_{in}$ is a bandgap reference (BGR) source, which is well known in the art. Since a BGR source is frequently found on-chip in many ICs, it is a convenient choice for $V_{in}$.

In order to render the output current $I0_1$ relatively constant with changes in temperature, the width and length of the M0 are configured to produce a negative TEMPCO that offsets the positive TEMPCO of R0, or conversely the size of M0 is configured to produce a positive TEMPCO that offsets the negative TEMPCO of R0. The theory upon which this form of temperature compensation is predicated is as follows. The gate-to-source voltage $V_{gs}$ of M0 is the sum of the FET's on-voltage ($V_{on}$) and its threshold voltage ($V_t$). Thus, $$V_{gs}=V_{on}+V_t \tag{1}$$

where $$V_{on}=[(2Li_D)/(W\mu_n C_{ox})]^{0.5} \tag{2}$$

where L and W are the length and width, respectively, of M0, $i_D$ is the drain current, $C_{ox}$ is the capacitance associated with the gate oxide of M0, and $\mu_n$, the mobility of the n-type semiconductor of M0, is given by $$\mu_n=K_\mu T^{-1.5} \tag{3}$$

where $K_\mu$ is a well known constant determined empirically and T is temperature in degrees Kelvin.

On the other hand, the threshold voltage ($V_t$) is related to temperature as follows:

$$V_t(T)=V_t(T_0)-\alpha(T-T_0). \tag{4}$$

where $T_0$ is the initial temperature at which $V_t$ is evaluated and $\alpha$ is the temperature coefficient of $V_t$.

From these equations, it is apparent that as temperature increases, for example, $V_t$ and $\mu_n$ decrease. Since $\mu_n$ is in the denominator of $V_{on}$, as $\mu_n$ decreases, $V_{on}$ increases. Therefore, $V_{on}$ has a positive TEMPCO. But $V_t$ has a negative TEMPCO, so that $V_{gs}$, and hence its TEMPCO (both its sign and magnitude) depends on the relative magnitudes of the $V_{on}$ and $V_t$ terms in equation (1). In addition, however, and in accordance with one aspect of my invention, the size of M0 is designed so that $V_{gs}$ has a negative TEMPCO of sufficient magnitude to offset the positive TEMPCO of R0. The offset is preferably such that these two TEMPCOs are equal in magnitude and opposite in sign. Of course, those skilled in the art will appreciate that precise equality is not essential inasmuch as considerable benefit, in terms of output current stability, can be achieved even when the two TEMPCOs are nearly equal to one another.

Figure 2:
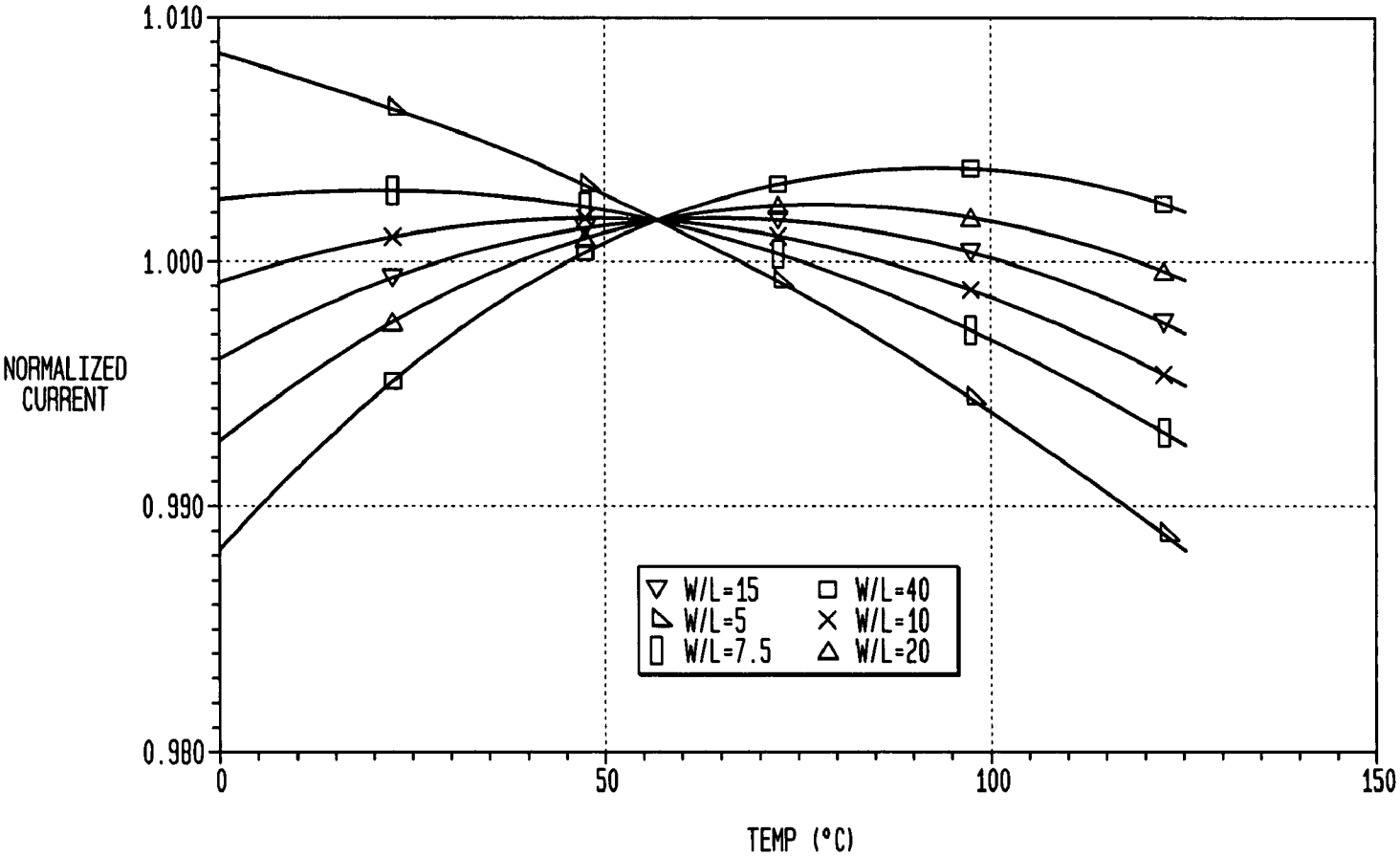
FIG. 2 is a graph showing how normalized output current ($I0_1$) varies with different values of the ratio of the width (W) to the length (L) of the FET (M0)

More specifically, the width (W) and length (L) of M0 are tuned (i.e., designed) so that the desired $V_{on}$, and hence a desired TEMPCO of $V_{gs}$ that offsets the TEMPCO of R0, is attained over the operating temperature range of the constant current source. FIG. 2 illustrates how the normalized output current $I0_1$ varies with temperature from 0° C. to 125° C. for various ratios W/L. The output current is most stable in two cases: W/L=10, where $0.999<I0_1<1.020$ from 0° C. to about 60° C. and $0.995>I0_1>1.020$ from about 60° C. to about 125° C. Comparable stability is demonstrated for the case W/L=15.

Figure 3:
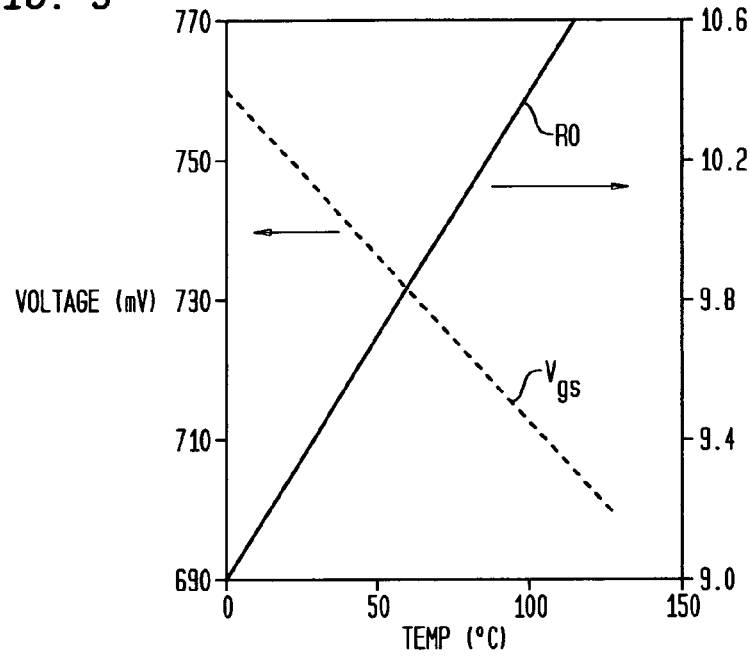
FIG. 3 is a graph demonstrating that the resistor (R0) has a positive TEMPCO and that, in a FET designed in accordance with one embodiment of my invention, the gate-to-source voltage ($V_{gs}$) has a negative TEMPCO.

For the case W/L=15, FIG. 3 shows how $V_{gs}$ and R0 vary with temperature and how the output current $I0_1$ remains constant at about 50 μA for a constant input voltage $V_{in}$=1.2 V.

Figure 4:
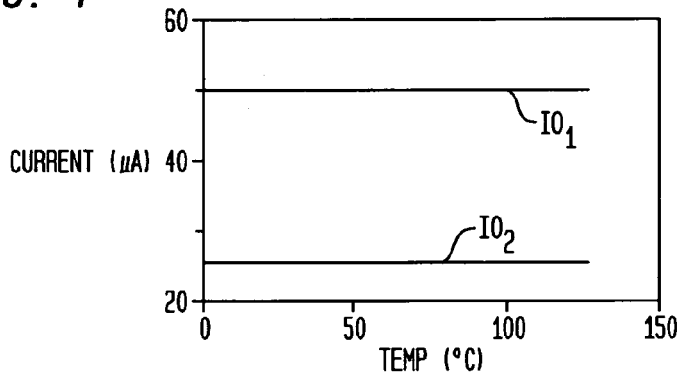
FIG. 4 is a graph showing how the constant values of the output currents ($I0_1$ and $I0_2$) vary with temperature, in accordance with one embodiment of my invention, using the circuit of FIG. 1 having the characteristics of FIG. 3.
Figure 5:
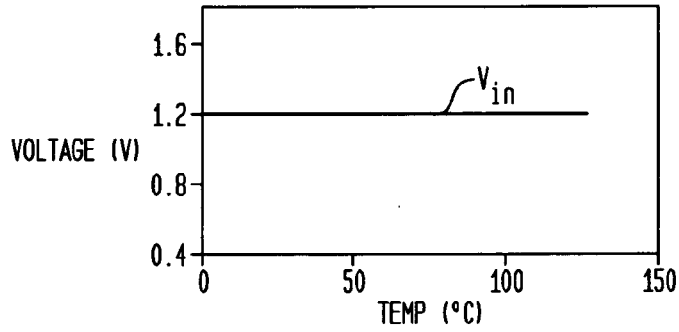
FIG. 5 is a graph showing the constant value of the input voltage ($V_{in}$) with temperature, which was utilized in the calculations that led to the graphs of FIGS. 3 and 4.

It is to be understood that the above-described arrangements are merely illustrative of the many possible specific embodiments that can be devised to represent application of the principles of the invention. Numerous and varied other arrangements can be devised in accordance with these principles by those skilled in the art without departing from the spirit and scope of the invention. In particular, in an alternative embodiment of my invention, as shown in FIG. 1, a conventional current mirror 20 is coupled between the drain terminal of M0 and the supply voltage source, thereby generating the constant current $I0_2=mI0_1$, where the multiplier m is any real number. In the illustration discussed above in conjunction with FIGS. 3–5, $I0_1$=50 μA and $I0_2$=25 μA. Therefore, m=0.5. In general, mirrored current such as $I0_2$ may be supplied to as many other circuits on the chip that require a stable and accurate current.

In practice, standard IC technology (e.g., well known silicon semiconductor processing) is employed to fabricate my constant current source 10 on the same chip as other circuit components, including for example a BGR input voltage source $V_{in}$ and the optional current mirror 20. The particular W/L ratio that gives a temperature independent constant current output $I0_1$ of M0 is implemented primarily by properly designing the IC masks that are used to pattern the width and length of M0. Once M0 is tuned in this fashion, the temperature characteristics of $I0_1$ remain relatively stable notwithstanding manufacturing process variations. Then, the magnitude of $I0_1$ may be adjusted, if necessary, by trimming R0 (typically by means of well known automatic test equipment).

I claim:

1. A constant current source comprising:

a field effect transistor having gate, source and drain terminals, the gate-to-source voltage of said transistor having a first temperature coefficient, and said drain terminal being coupled to a source of supply voltage and delivering an output current, a resistor coupled between said source terminal and a source of reference potential, the resistance of said resistor having a second temperature coefficient, said gate terminal being coupled to a source of voltage that is essentially constant with changes in temperature over the operating range of said current source, and the width and length of said transistor being configured so that said first and second coefficients offset one another and said output current is essentially constant with changes in temperature over said range.

2. The source of claim 1, wherein said gate terminal is coupled to a source of bandgap reference voltage.

3. The source of claim 1, further including a current mirror coupled between said drain terminal and said source of supply voltage.

4. An integrated circuit comprising:

a bandgap reference voltage source formed on a chip, and a constant current source formed on said chip, said current source including a MOSFET having gate, source and drain terminals, the gate-to-source voltage of said transistor having a first temperature coefficient, and said drain terminal for coupling to a source of supply voltage and delivering an output current, a resistor coupled between said source terminal and a source of reference potential, the resistance of said resistor having a second temperature coefficient, said gate terminal being coupled to said bandgap reference voltage source, and the width and length of said transistor being configured so that said first and second coefficients offset one another and said output current is essentially constant with changes in temperature over the operating range of said circuit.

5. The source of claim 4, further including a current mirror formed on said chip and coupled between said drain terminal and said source of supply voltage.

6. A method of making an integrated circuit comprising the steps of:

(a) forming a FET on a chip, the gate-to-source voltage of the transistor having a first temperature coefficient, forming the drain terminal of the transistor to couple to a terminal of a source of supply voltage and to deliver an output current, and forming the gate terminal of the transistor to couple to a source of input voltage that is essentially constant over the operating temperature range of the circuit, (b) forming a resistor on the chip, the resistor having a second temperature coefficient, and forming the resistor to couple between the source terminal of the transistor and a source of reference potential, and (c) configuring the width and length of the transistor so that the first and second temperature coefficients offset one another and the output current is essentially constant with changes in temperature over the operating range of said circuit.

7. The method of claim 6, further including the step of forming the source of input voltage on the chip as a bandgap reference voltage source.

8. The method of claim 6, further including the step of adjusting the magnitude of the output current by trimming the resistor.

9. The method of claim 6, further including the step of forming a current mirror on the chip between the drain terminal and the terminal of the source of supply voltage.

* * * * *